US008025545B2

(12) United States Patent
Zahornacky et al.

(10) Patent No.: US 8,025,545 B2
(45) Date of Patent: Sep. 27, 2011

(54) SYSTEM AND METHOD FOR SUBSTANTIALLY SYNCHRONIZING SOUND AND SMOKE IN A MODEL VEHICLE

(75) Inventors: Jon F. Zahornacky, Santa Clara, CA (US); Steven Edward Ziemba, Grosse Pointe Park, MI (US); Neil P. Young, Woodside, CA (US); Bruce R. Koball, Berkely, CA (US)

(73) Assignee: Lionel L.L.C., Chesterfield, MI (US)

( * ) Notice: Subject to any disclaimer, the term of this patent is extended or adjusted under 35 U.S.C. 154(b) by 229 days.

(21) Appl. No.: 12/206,492

(22) Filed: Sep. 8, 2008

(65) Prior Publication Data

US 2010/0062675 A1 Mar. 11, 2010

(51) Int. Cl.
*A63H 19/14* (2006.01)

(52) U.S. Cl. ..... 446/25; 446/270; 246/187 A

(58) Field of Classification Search ..... 446/24, 446/25

See application file for complete search history.

(56) References Cited

U.S. PATENT DOCUMENTS

| | | | | |
|---|---|---|---|---|
| 5,361,705 | A * | 11/1994 | Powell | 104/60 |
| 7,210,656 | B2 * | 5/2007 | Wolf et al | 246/4 |
| 7,211,976 | B2 * | 5/2007 | Denen et a | 318/286 |
| 7,666,052 | B2 * | 2/2010 | Pierson | 446/25 |
| 7,684,570 | B2 * | 3/2010 | Riggs | 381/86 |
| 7,749,040 | B2 * | 7/2010 | Grubba | 446/25 |

* cited by examiner

*Primary Examiner* — Gene Kim
*Assistant Examiner* — Matthew B Stanczak
(74) *Attorney, Agent, or Firm* — O'Melveny & Myers LLP

(57) ABSTRACT

A system and method is provided for substantially synchronizing sound and smoke in a model train or other model vehicle. In one embodiment of the present invention, a sensor is configured to send a signal periodically to a smoke generating device and a controller, wherein the signal is used by the smoke generating device to produce a particular quantity of smoke. The controller is then configured to receive a signal from a motor, wherein the signal includes information that can be used to identify a rotational position of the motor, or a rotational position of an axle in communication with the motor. The controller then uses the signal from the sensor and the signal from the motor to estimate a transmission lime of a next signal from the sensor, wherein the next signal is used by the smoke generating device to produce a next production of smoke.

9 Claims, 3 Drawing Sheets

SYSTEM AND METHOD FOR SUBSTANTIALLY SYNCHRONIZING SOUND AND SMOKE IN A MODEL VEHICLE

BACKGROUND OF THE INVENTION

1. Field of the Invention

The present invention relates to accessories for model vehicles or, more particularly, to a system and method of substantially synchronizing sound and smoke, or the like, in a model train or other model vehicle.

2. Description of Related Art

Model train engines having smoke generating devices are well known in the art. Some smoke generating devices generate smoke at a substantially constant rate. More sophisticated smoke generating devices may produce smoke at a rate proportional to a speed of a train, or to a loading of a motor of the train. In operation, these devices often function in conjunction with a sound generating device. For example, certain model train engines, in an effort to simulate a real steam engine, are configured to produce both a billow of smoke and a "chuffing" sound.

A common drawback, however, is that the sound generating device is not generally synchronized to the smoke generating device. For example, the sound generating device may produce a "chuffing" sound slightly before (or slightly after) the smoke generating device produces a quantity of smoke. Another common drawback is that the smoke and sound generating devices are not generally synchronized to the motor of the train, or movement of a piston and/or valve therein. This is important because, in a real steam engine, the "chuffing" sound is produce in response to a valve opening, thereby allowing a corresponding piston to move steam out of a corresponding cylinder.

In an effort to overcome the foregoing drawbacks, certain model trains use a cam to synchronize the sound generating device to both the smoke generating device and the motor. Specifically, the cam, which is typically connected to an axle of the train and includes a plurality of lobes, is configured to rotate once per revolution of the axle. Each lobe is then configured to activate the smoke and sound generating devices once per revolution (e.g., by toggling a switch). Because a common lobe is used to activate both the smoke and sound generating devices, the sound generating device is synchronized to the smoke generating device. Further, because the common lobe is tied to the axle, which in turn is tied to the motor, it appears (to a user) that the sound generating device is also synchronized to the motor.

A drawback of such a system, however, is that it generally results in an uneven production of sound and smoke. This is because the lobes on the cam are often imperfect, either in size and/or spacing. For example, different sized lobes can result in a first time (e.g., four seconds) between first and second "chuffing" sounds, and a second time (e.g., five seconds) between second and third "chuffing" sounds. This uneven production of sound can be quite distracting and disheartening to a model train enthusiast.

Thus, it would be advantageous to provide a model train system and method that overcomes at least some of the foregoing drawbacks.

SUMMARY OF THE INVENTION

The present invention provides a system and method for substantially synchronizing sound and smoke, or the like, in a model train or other model vehicle. Preferred embodiments of the present invention operate in accordance with a sensor, a controller, a motor, a smoke generating device, and a sound generating device.

In a first embodiment of the present invention, the sensor is configured to send a signal periodically to the smoke generating device. The signal is used by the smoke generating device to produce a particular quantity of smoke. For example, the signal may be used to activate a fan in order to move smoke (e.g., as generated by a smoke unit) out of a smokestack of a model vehicle.

In one embodiment of the present invention, the sensor includes a cam that includes a plurality of lobes, and a switch that is in communication with at least a voltage potential and the smoke generating device. By tying the cam to an axle of the model vehicle, the cam can be configured to rotate once per revolution of the axle, causing the four lobes to activate the switch four times per revolution of the axle. Each time that the switch is activated, it produces a voltage potential that can be used to activate (or trigger) the smoke generating device.

In accordance with the first embodiment of the present invention, the controller is configured to receive signals from both the sensor and the motor. Preferably, the signal from the motor includes information that can be used to identify a rotational position of the motor, or a rotational position of an axle in communication with the motor. For example, the motor, which may be controlled by the controller, may be configured to transmit a "count" (or pulses) to the controller that can be used to identify a rotational position of the motor and/or axle.

The controller is then adapted to use the signal from the sensor (as provided to the smoke generating device) and the signal from the motor to estimate (or predict) a transmission time of a next (or second) signal from the sensor, wherein the next (or second) signal is used by the smoke generating device to produce a next (or second) production of smoke. In one embodiment of the present invention, the controller does this by using (i) the signal from the sensor to identify a first count from the motor, and (ii) the first count (e.g., together with "chuffs" per revolution) to identify a second count from the motor, which corresponds to a transmission time of a next (or second) signal from the sensor.

By way of example, assume that the sensor is configured to transmit four signals (or pulses), wherein the first signal is transmitted when the axle is substantially at 0°, the second signal is transmitted when the axle is substantially at 90°, the third signal is transmitted when the axle is substantially at 180°, and the fourth signal is transmitted when the axle is substantially at 270°. Further assume that the controller is configured to receive, from the motor, sixty counts per revolution of the motor and/or axle, and receives the first signal from the sensor at substantially the same time as it receives a count of four (i.e., 4/60) from the motor. The controller can then estimate (or predict) that the sensor will transmit a second signal, and that the smoke generating device will produce a second quantity of smoke, at a count of nineteen (i.e., 19/60). This is because four evenly-spaced signals per revolution is equal to one signal every fifteen counts, and four (i.e., the first count) plus fifteen is nineteen. The controller can also estimate (or predict) that the sensor will transmit third and fourth signals at counts of thirty-four (i.e., 19+15) and forty-nine (i.e., 34+15), respectively.

The controller then uses the "estimated time" to transmit a signal to the sound generating device, wherein the signal is used by the sound generating device to produce a "chuffing" sound. In an alternate embodiment of the present invention, the system further includes a converter that is configured to receive a periodic signal from the controller (e.g., at counts of 19, 34 and 49), convert the signal into a serial signal that corresponds to a "chuffing" sound, and transmit the serial signal to the sound generating device, where it is used by the sound generating device to produce a "chuffing" sound. This embodiment allows, for example, the sound generating device to produce a plurality of sounds, wherein each sound corresponds to a different serial signal.

In a second embodiment of the present invention, the controller is further configured to control both the sound generating device and the smoke generating device. For example, the controller may be configured to (i) use a signal from the sensor and a signal from the motor to estimate a transmission time of a next (or second) signal from the sensor, and (ii) transmit a signal to both the smoke generating device and the sound generating device at the estimated time, wherein the signal is used by the smoke and sound generating devices to produce a quantity of smoke and a "chuffing" sound, respectively.

A more complete understanding of a system and method for substantially synchronizing sound and smoke in a model vehicle will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a system and method of substantially synchronizing sound and smoke, or the like, in a model train or other model vehicle. In the detailed description that follows, like element numerals are used to describe like elements illustrated in one or more figures.

Figure 1:
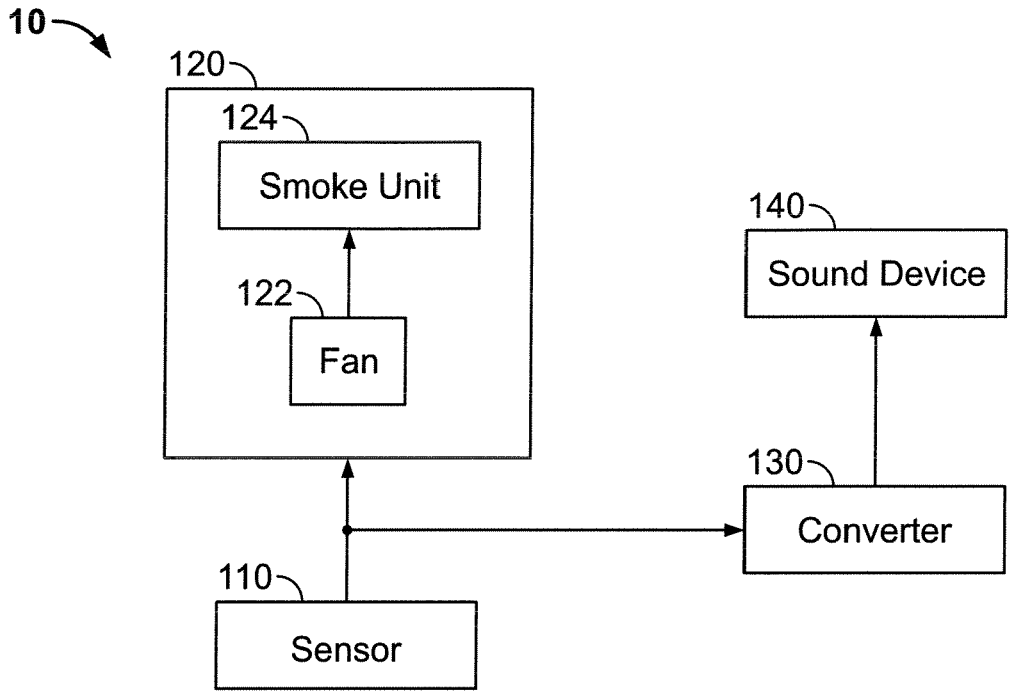
FIG. 1 (Prior Art)
FIG. 1 illustrates a prior art smoke/sound generating system.

Model vehicles having smoke generating devices and sound generating devices are generally known in the art. For example, FIG. 1 illustrates a traditional smoke/sound generating system 10 comprising a sensor 110 (e.g., a cam and a switch), a smoke generating device 120, a converter 130 and a sound generating device 140, wherein the smoke generating device 120 includes a smoke unit 124 for generating smoke, or the like, and a fan 122 for moving the smoke via an opening in a model vehicle (not shown) (e.g., a smokestack). The sensor 110 is configured to transmit multiple signals per revolution of an axle (or wheel) of the model vehicle. The multiple signals are transmitted to the smoke generating device 120 and used to generate multiple quantities of smoke. The multiple signals are also transmitted to the converter 130, where they are converted to serial signals that corresponds to a "chuffing" sound. The serial signals are then transmitted to the sound generating device 140 and used to produce multiple "chuffing" sounds, wherein each "chuffing" sound is substantially synchronized to each production of smoke.

A drawback of such a system 10, however, is that the multiple sounds are often produced at varying times, or "unevenly." For example, a second sound may be produced four seconds after a first sound, whereas as third sound may be produced five seconds after a second sound. This "unevenness," which is generally the result of an imperfection in the sensor 110, can be quite distracting to a model train enthusiast. The present invention overcomes this drawback by synchronizing the smoke and/or sound generating devices to a motor, or a signal related thereto.

Figure 2:
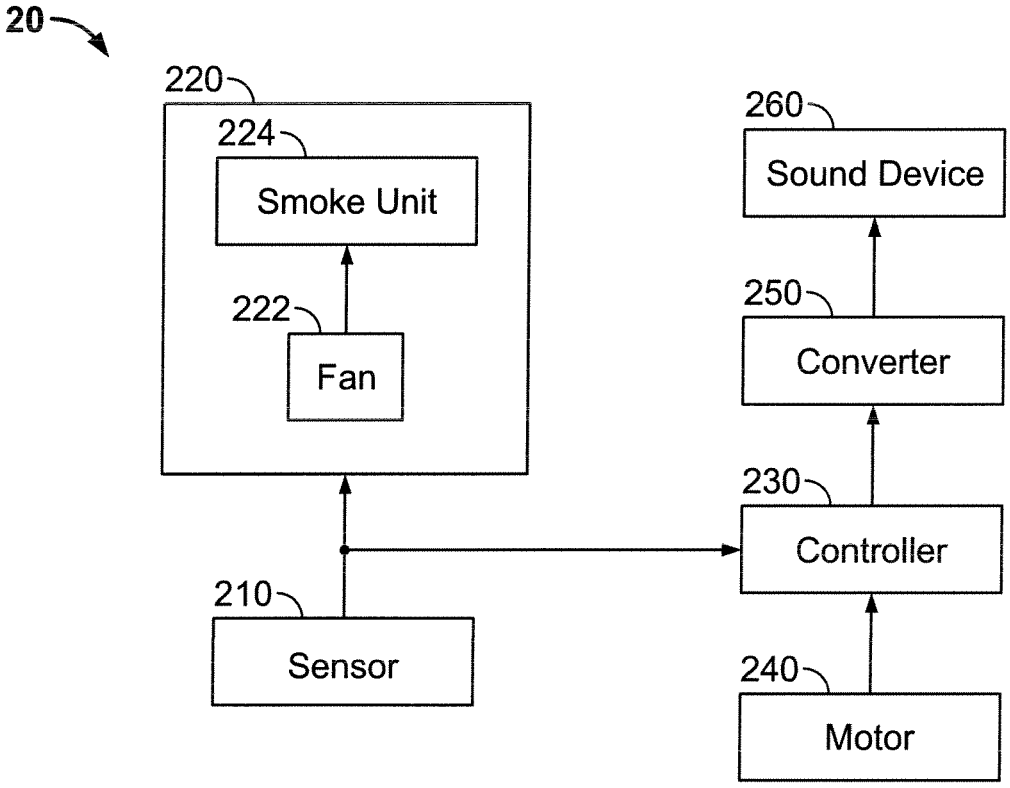
FIG. 2 illustrates a smoke/sound generating system in accordance with one embodiment of the present invention.

A smoke/sound generating system in accordance with one embodiment of the present invention is shown in FIG. 2. Specifically, the system 20 includes a sensor 210, a smoke generating device 220, a controller 230, a motor 240 and a sound generating device 260, wherein the smoke generating device 220 includes a smoke unit 224 for producing a quantity of smoke and a fan 222 for moving the quantity of smoke out of a model vehicle (not shown) (e.g., via an opening in the model vehicle, including, but not limited to, a smokestack). It should be appreciated that while certain components are depicted in FIG. 2, this figure does not show certain (necessary and/or optional) components that are commonly known to those skilled in the art. Thus, smoke/sound generating systems that include additional (or fewer) components, are within the spirit and scope of the present invention. It should further be appreciated that the sensor depicted in FIG. 2 includes, but is not limited to, optical sensors, electrical sensors (e.g., a switch), magnetic sensors, mechanical sensors (e.g., a cam) and/or all other sensors generally known to those skilled in the art. It should also be appreciated that the term "smoke," as that term is used herein, should be construed broadly to include smoke, steam and/or gases that can be used to simulate the production of smoke and/or steam. Thus, the smoke generating device depicted in FIG. 2 includes, but is not limited to, devices for generating actual smoke, steam and/or gas.

The sensor 210 is adapted to send a signal periodically to the smoke generating device 220. The signal is used by the smoke generating device 220 to produce a particular quantity of smoke. For example, the signal can be used to activate a fan 222 in order to move (or remove) smoke from the model vehicle. In one embodiment of the present invention, a smoke unit 224 is used to create smoke (e.g., actual smoke, steam and/or gas). The fan 222, which is periodically activated, is then used to push a quantity (e.g., a billow) of the smoke out the model vehicle (e.g., via a smokestack). This is done to simulate a production of steam, as seen in actual steam engines.

The controller 230 is adapted to receive signals from both the sensor 210 and the motor 240. Preferably, the signal from the motor includes information that can be used to identify a rotational position of the motor 240, or a rotational position of an axle (not shown) in communication with the motor 240. For example, the motor 240 is generally configured to move a model vehicle by rotating at least one axle, and therefore at least one wheel. The motor 240, which may be controlled by the controller 230, may also be configured to transmit a signal to the controller that can be used to identify a rotational position of the motor and/or axle. For example, the motor 240 may transmit a count (or pulses) to the controller 230. In one embodiment of the present invention, the motor 240 is configured to transmit a count from one to fifty-eight to identify a rotational position of the motor and/or axle, where a count of one is 1/58 of a rotation, a count of two is 2/58 of a rotation, and a count of fifty-eight is 58/58 of a rotation, or one complete rotation. It should be appreciated that the term "motor," as that term is used herein, should be construed broadly to include certain mechanical, electrical and magnetic components that are generally included therein. For example, the motor may include electronics for receiving, processing and/or transmitting various signals (e.g., a receiver, encoder, transmitter, etc). It should also be appreciated that the present invention is not limited to the transmission of a "count," but includes the transmission of any signal that can be used to identify (or approximate) the rotational revolution of a motor, axle and/or wheel.

The controller 230 is further adapted to use the signal from the sensor 210 (as provided to the smoke generating device) and the signal from the motor 240 to estimate (or predict) (i) a time that a subsequent signal from the sensor 210 will be transmitted and/or (ii) a time that a subsequent quantity of smoke from the smoke generating device 220 will be produced. In one embodiment of the present invention, the signal from the sensor 210 is used to identify a first count from the motor 240, which is then used to identify a second count that is substantially synchronized to a subsequent signal from the sensor 210 and/or a subsequent production of smoke from the smoke generating device 220.

By way of example, assume that the sensor 210 is configured to transmit four signals (or pulses), wherein the first signal is transmitted when the axle is substantially at 0°, the second signal is transmitted when the axle is substantially at 90°, the third signal is transmitted when the axle is substantially at 180°, and the fourth signal is transmitted when the axle is substantially at 270°. Further assume that the controller 230 is configured to receive, from the motor 240, sixty counts per revolution of the motor and/or axle, and receives the first signal from the sensor 210 at substantially the same time as it receives a count of four (i.e., 4/60) from the motor 240. The controller 230 can then estimate (or predict) that the sensor 210 will transmit a second signal, and that the smoke generating device 220 will produce a second quantity of smoke, at a count of nineteen (i.e., 19/60). This is because four evenly-spaced signals per revolution is equal to one signal every fifteen counts, and four (i.e., the first count) plus fifteen is nineteen. The controller 230 can also estimate (or predict) that the sensor 210 will transmit third and fourth signals at counts of thirty-four (i.e., 19+15) and forty-nine (i.e., 34+15), respectively.

The controller 230 then uses the "estimated times" to transmit signals to the sound generating device 260, wherein each signal results in a "chuffing" sound. For example, a first signal may be transmitted to the sound generating device 260 at a first estimated time, a second signal may be transmitted to the sound generating device 260 at a second estimated time, etc. The result is a smoke/sound generating system 20, wherein a production of sound is substantially synchronized to a production of smoke. It should be appreciated that, while the present invention has be described in terms of a controller that is adapted to use a first signal from a sensor and a signal from a motor to estimate a transmission time of a second signal from the sensor and/or a second production of smoke, the present invention is not so limited. For example, a controller that is configured to use a first signal from a sensor and a signal from a motor to estimate transmission times of second and third signals from the sensor is within the spirit and scope of the present invention. By way of another example, a controller that is configured to use a first signal from a sensor and a signal from a motor to estimate transmission times of second, third and fourth signals from the sensor, and to use a fifth signal from the sensor and a subsequent signal from the motor to estimate transmission times of sixth, seventh and eighth signals from the sensor, is also within the spirit and scope of the present invention.

In an alternate embodiment of the present invention, the smoke/sound generating system 20 further includes a converter 250 that is configured to receive a periodic signal (or trigger) from the controller 230 (e.g., at counts of 19, 34 and 49), convert the signal (or trigger) into a serial signal that corresponds to a "chuffing" sound, and transmit the serial signal to the sound device 260. This would allow the sound device 260 to produce a plurality of sounds, including, but not limited to, a "chuffing" sound in response to receiving the serial signal from the converter 250.

Figure 3:
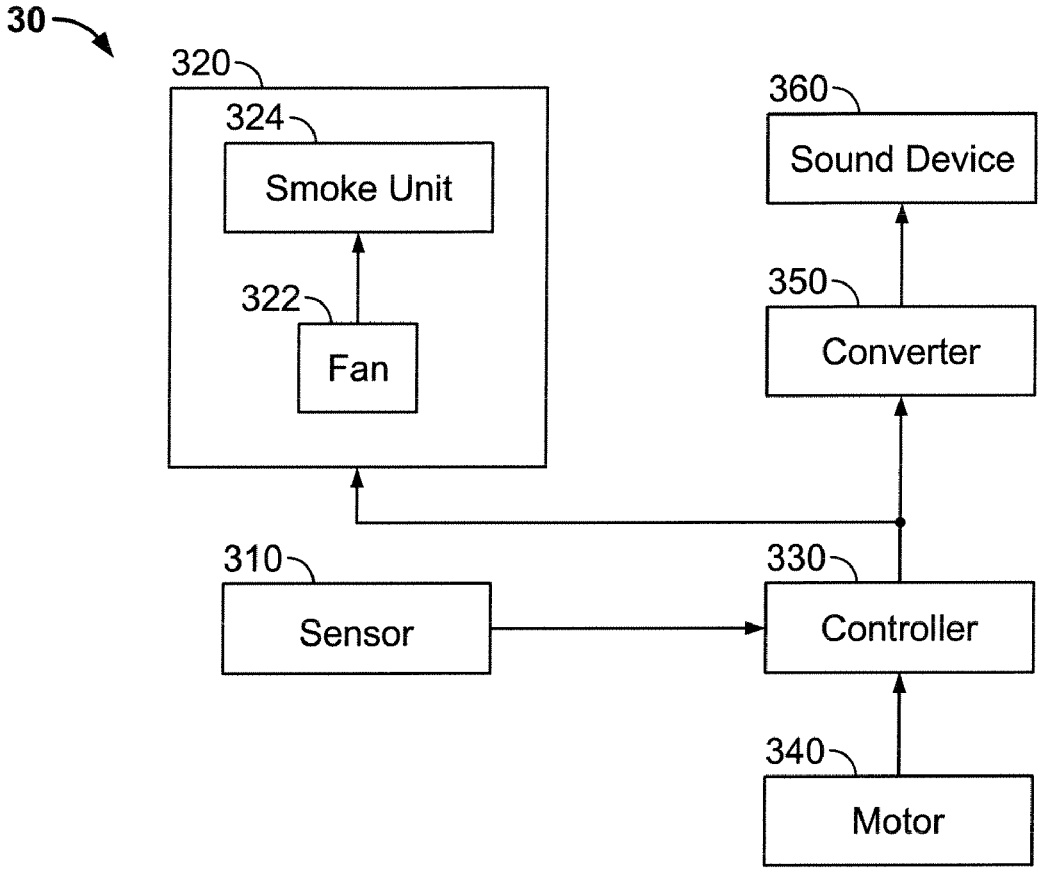
FIG. 3 illustrates a smoke/sound generating system in accordance with a second embodiment of the present invention.

In a second embodiment of the present invention, as shown in FIG. 3, the smoke/sound generating system 30 operates as previously described in connection with FIG. 2, except that the controller 330 is further configured to control the smoke generating device 320. In this embodiment, the controller 330 is configured to use a signal from the sensor 310 and a signal from the motor 340 to estimate a time of a subsequent signal from the sensor, and to transmit a signal to both the smoke generating device 320 and the sound generating device 360 at the estimated time. This is opposed to FIG. 2, where the controller 230 is only configured to transit a signal to the sound generating device at the estimated time.

Figure 4:
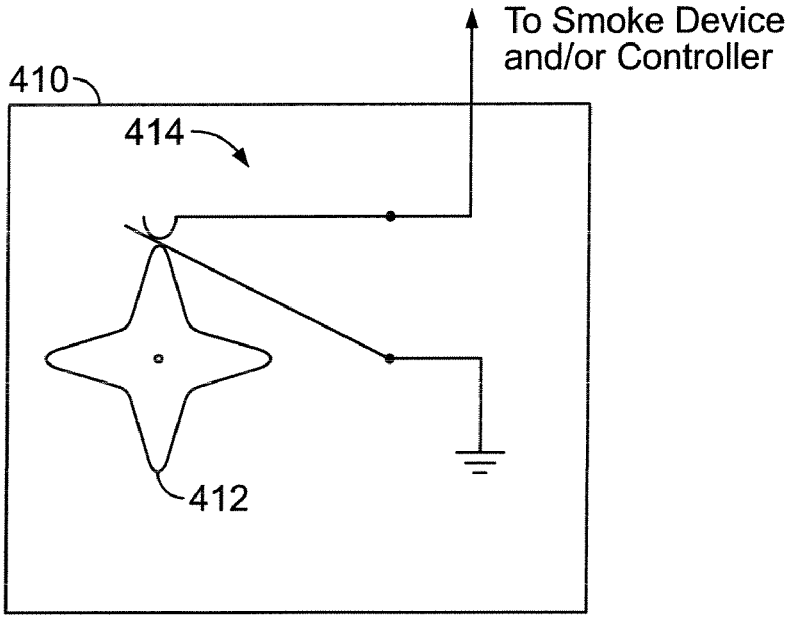
FIG. 4 illustrates one embodiment of a sensor for the smoke/sound generating systems depicted in FIGS. 2 and 3.

FIG. 4 depicts a sensor 410 that can be used in the foregoing embodiments. As shown in FIG. 4, the sensor 410 includes a cam 412 that includes a plurality of lobes, and a switch 414 that is in communication with a voltage potential (e.g., ground), the smoke generating device, and/or the controller (see, e.g., FIGS. 2 and 3). By tying the cam 412 to an axle of the model vehicle (not shown), the cam 412 can be configured to rotate once per revolution of the axle, causing the four lobes to activate the switch 414 four times per revolution of the axle. Each time the switch 414 is activated, it produces a voltage potential (e.g., zero volts, or ground), that can be used to activate (or trigger) the smoke generating device and/or the controller (see, e.g., FIGS. 2 and 3). It should be appreciated, however, that the sensor depicted in FIG. 4 is not limited to a cam having four lobes, or a switch connected to ground. Thus, for example, a cam that includes fewer (or more) lobes, and a switch that is connected to $V_{dd}$, is within the spirit and scope of the present invention.

Figure 5:
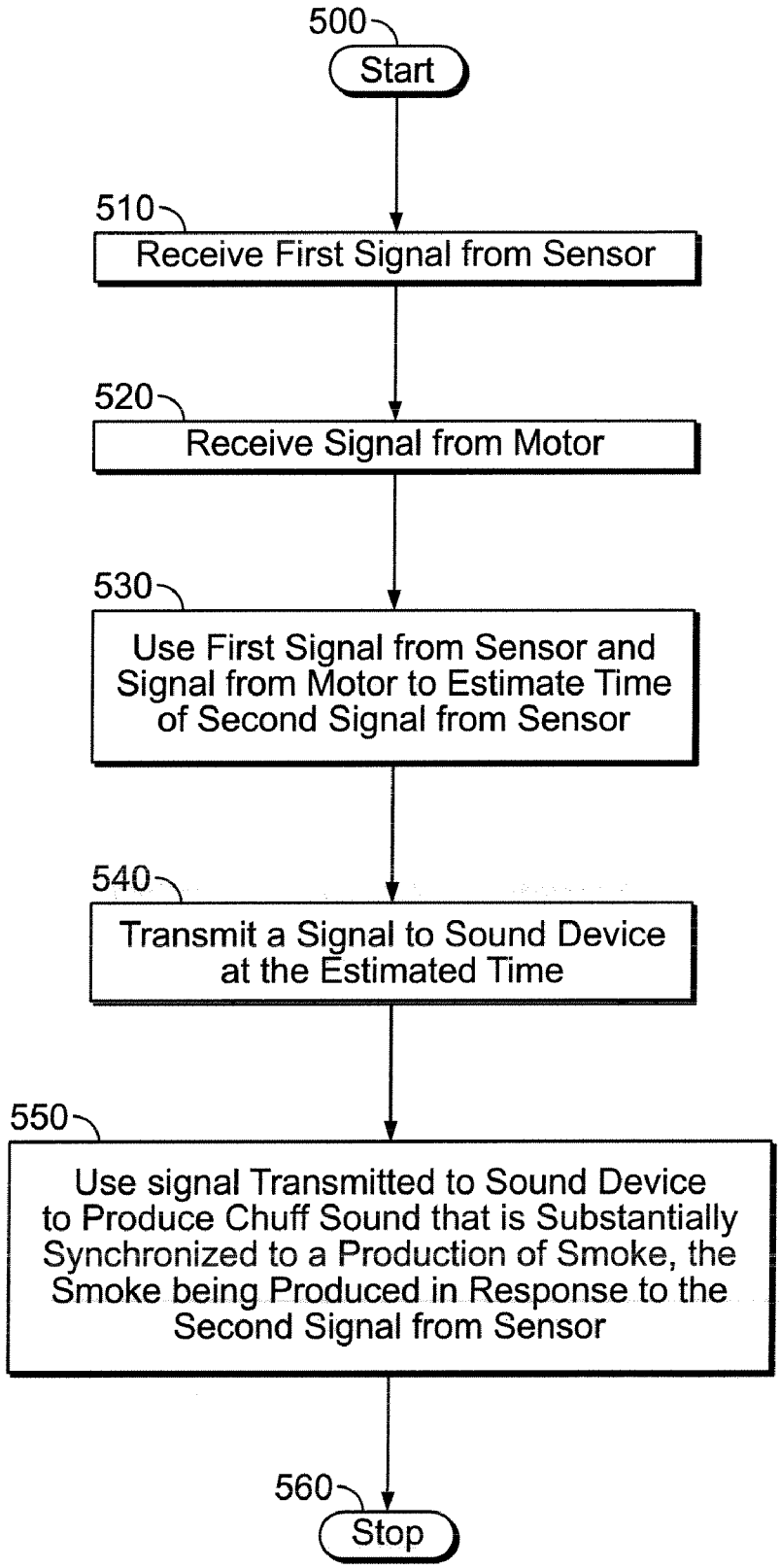
FIG. 5 provides a method for substantially synchronizing smoke and sound in a model vehicle.

FIG. 5 provides a method of substantially synchronizing sound and smoke in a model vehicle in accordance with one embodiment of the present invention. Specifically, starting at step 500, a first signal is receive from a sensor at step 510, and a signal is received from a motor at step 520, wherein the signal received from the motor preferably includes positional (or count) information. At step 530, the first signal from the sensor and the signal from the motor are used to estimate a time that a second signal will be receive from the sensor. In a preferred embodiment, this is done by using the first signal from the sensor to identify a particular count from the motor. This count is then used together with a number of "chuffs" per revolution (which is either stored in memory or determined using signals received from the sensor) to identify a particular count corresponding to a time that a second signal will be receive from the sensor. At step 540, a signal is then transmitted (either directly or indirectly) to a sound generating device at the estimated time. At step 550, the sound generating device uses this signal to produce a "chuffing" sound that is substantially synchronized to a production of smoke, wherein the smoke is produced in response to receiving the second signal from the sensor, ending the method at step 560.

Having thus described several embodiments of a system and method for substantially synchronizing sound and smoke in a model vehicle, it should be apparent to those skilled in the art that certain advantages of the system and method have been achieved. It should also be appreciated that various modifications, adaptations, and alternative embodiments thereof may be made within the scope and spirit of the present invention. The invention is solely defined by the following claims.

What is claimed is:

1. A method for substantially synchronizing sound and smoke in a model vehicle, comprising:

transmitting at least first and second signals from a sensor in response to movement of a model vehicle;

producing a first quantity of smoke in response to receiving at least said first signal;

producing a second quantity of smoke in response to receiving at least said second signal;

using at least said first signal to identify at least a portion of a third signal, said third signal being receive from a motor configured to move said model vehicle;

using at least said portion of said third signal to estimate a time of said transmission of said second signal from said sensor;

transmitting at least a fourth signal to a sound generating device at said time;

using at least said fourth signal to produce a sound that is substantially synchronized to said second quantity of smoke.

2. The method of claim 1, wherein said step of transmitting at least said first and second signals from said sensor further comprises transmitting at least said first and second signals from a switch, said switch being activated by a cam that is adapted to rotate in response to said movement of said model vehicle.

3. The method of claim 1, wherein said step of producing said first quantity of smoke further comprises generating said first quantity of smoke and moving said first quantity of smoke out of said model vehicle via at least one opening in said model vehicle.

4. The method of claim 1, wherein said step of transmitting at least first and second signals from a sensor further comprises transmitting a plurality of signals for each revolution of an axle of said model vehicle.

5. The method of claim 1, wherein said step of using at least said third signal to estimate said time further comprises using at least said third signal to estimate a plurality of times, wherein each one of said plurality of times corresponds to at least a third and fourth production of smoke.

6. The method of claim 1, wherein said step of transmitting at least said fourth signal to said sound generating device at said time further comprises converting said fourth signal into a serial signal prior to being transmitted to said sound generating device.

7. The method of claim 1, wherein said step of transmitting at least said first and second signals from said sensor in response to said movement of said model vehicle further comprises transmitting at least said first and second signals from said sensor in response to movement of a model train engine.

8. The method of claim 7, wherein said step of producing said first quantity of smoke in response to receiving at least said first signal further comprises producing a billow of smoke in response to receiving at least said first signal.

9. The method of claim 7, wherein said step of using at least said fourth signal to produce said sound that is substantially synchronized to said second quantity of smoke further comprises using at least said fourth signal to produce a train chuffing sound that is substantially synchronized to said second quantity of smoke.

* * * * *